US005184604A

United States Patent [19]

Brillante

[11] Patent Number: 5,184,604

[45] Date of Patent: Feb. 9, 1993

[54] ANIMAL MOUTH RETRACTOR

[76] Inventor: Jose C. Brillante, 2147 O Street, NW., Apt. 300, Washington, D.C. 20037

[21] Appl. No.: 784,522

[22] Filed: Oct. 29, 1991

[51] Int. Cl.[5] ..... A61D 1/00

[52] U.S. Cl. ..... 128/14; 128/20

[58] Field of Search ..... 128/20, 14, 19, 12, 128/3, 15; 119/129

[56] References Cited

U.S. PATENT DOCUMENTS

| | | |
|---|---|---|
| 120,062 | 10/1871 | Hallock . |
| 314,527 | 3/1885 | Green . |
| 355,442 | 1/1887 | Dunn . |
| 402,068 | 4/1889 | Crannell . |
| 403,534 | 5/1889 | Holand . |
| 404,652 | 6/1889 | Palmer . |
| 415,715 | 11/1889 | Harter . |
| 421,814 | 2/1890 | Bunce . |
| 442,180 | 12/1890 | Halfpenny . |
| 457,911 | 8/1891 | Edwards . |
| 472,939 | 4/1892 | Barnes . |
| 477,838 | 6/1892 | Elliott . |
| 486,153 | 11/1892 | Ziegler . |
| 490,602 | 1/1893 | Ryan . |
| 497,064 | 5/1893 | Van Meter . |
| 548,194 | 10/1895 | Haussmann . |
| 574,591 | 1/1897 | Walker . |
| 585,101 | 6/1897 | Hymer . |
| 682,832 | 9/1901 | McPherson . |
| 685,710 | 10/1901 | Cannon . |
| 692,565 | 2/1902 | Weder . |
| 714,369 | 11/1902 | Fleming . |
| 886,522 | 5/1980 | Kyle . |
| 1,089,653 | 3/1914 | Littauer . |
| 1,154,748 | 9/1915 | Dunn . |
| 1,875,158 | 5/1930 | Rombough . |
| 1,915,454 | 6/1933 | Steigenberger . |
| 2,096,083 | 10/1937 | Berzina . |
| 2,587,129 | 2/1952 | Fehrman . |
| 2,651,300 | 9/1953 | Fehrman . |
| 2,775,965 | 1/1957 | Montgomery . |
| 2,827,042 | 3/1958 | Berrier, Jr. . |

FOREIGN PATENT DOCUMENTS

| | | | |
|---|---|---|---|
| 49296 | 9/1931 | Norway | 128/19 |
| 119310 | 1/1959 | U.S.S.R. | 119/129 |

*Primary Examiner*—Richard J. Apley
*Assistant Examiner*—Karen A. Jalbert
*Attorney, Agent, or Firm*—Watson, Cole, Grindle & Watson

[57] ABSTRACT

A device is provided for maintaining the upper and lower jaws of an animal separated from one another, which does not interfere with an endotracheal tube during an intubation procedure. A stationary retainer and a movable retainer are biased apart from one another by at least one spring. Two separator rods are provided which maintain the retainers in alignment with one another. The device is especially useful for retracting the mouth of an animal which does not have protruding canine teeth.

22 Claims, 3 Drawing Sheets

ANIMAL MOUTH RETRACTOR

FIELD OF THE INVENTION

The present invention relates to an apparatus for use by veterinarians, technicians, or researchers attempting to place an endotracheal tube into and down the trachea of anesthetized animals. More generally, the invention relates to an apparatus for use in retaining the mouth of anesthetized laboratory animals open during endotracheal intubation and oral surgery procedures and during mouth and throat examinations.

BACKGROUND OF THE INVENTION

It is a time-honored practice in experimental surgery research and teaching that the dog is the laboratory animal of choice. But this practice has been changing over the last fifteen years. As the use of swine increased as the laboratory animal of choice, the use of dogs decreased substantially. Reasons for this decrease in the use of dogs in surgical research and teaching include the following: 1) studies show that the dog is the most liked animal in the United States, and therefore there is a public sentiment against the use of dogs in the laboratory; 2) there is a dwindling availability of dogs in areas where the use of pound dogs in the laboratory has been restricted by legislation; 3) commercial swine can be readily obtained more cheaply than dogs in many areas of the United States; and 4) the physiologic and anatomic structures of swine are more similar to man than dogs.

Other biomedical researchers also have looked to other animal species on which to conduct research. These animal species include, but are not limited to, sheep, goats, miniature swine, rabbits and ferrets. All these animals, when under general anesthesia, require an endotracheal tube.

Placing an endotracheal tube into and down the trachea of an anesthetized animal is very difficult to do by oneself. In the standard two-person technique, a designated assistant opens and retains open an animal's mouth by applying tension on gauze loops over the upper and lower jaws. A second person inserts an endotracheal tube into and down the trachea of the animal. Intubating an animal of any size, whether in ventral or dorsal recumbency, with the two-person technique presents a difficult task.

One known animal mouth retractor works well on dogs. As shown in FIGS. 1 and 2, the known retractor comprises a pair of spaced elongated arms 1 and 2 having holes 3 and 4, respectively, formed therethrough. These holes have a substantially square cross-section at a first end thereof and slidably receive a retainer rod 5 which has a complementary square cross-section. A compression spring 6 surrounds retainer rod 5 and has the opposite ends thereof in engagement with facing surfaces 7 and 8 of the two arms. Opposite ends of the rod are provided with threaded holes (not shown) which receive threaded bolts 9 and 10 therein. Washers 11 and 12 surround the bolts and are positioned between the ends of rod 5 and the heads of the bolts. The bolts and washers prevent the ends of the rod from passing through holes 3 and 4 and maintain spring 6 under compression.

Each of arms 1 and 2 have holes formed through the ends opposite the first ends thereof, which holes receive inserts 13 and 14, respectively. These inserts have holes formed therein for receiving the canine teeth of a dog and are formed of suitable material to prevent damage to the teeth.

The manner in which the retractor works is illustrated in FIG. 2 wherein the upper and lower canine teeth at one side of the dog's mouth are received within the inserts in the arms. The arms are urged apart by spring 6 to hold the jaws of the dog in spaced relationship.

Devices of the aforementioned type have been especially useful in experimental surgery research and teaching conducted on dogs. However, due to the reasons mentioned above, the use of dogs in surgical research and teaching has decreased while the use of swine and other animal species has increased. These other animal species include, but are not limited to, sheep, goats, cats, rabbits and ferrets. Since these alternative animals, unlike the dog, do not possess protruding canine teeth, the prior art mouth retractor shown in FIGS. 1 and 2 cannot be used. A need therefore exists for an animal mouth retractor which can be used on animals that do not possess protruding canine teeth. A need also exists for an animal mouth retractor which can be used on animals of different species and on animals of different sizes having different sized upper and lower jaws.

SUMMARY OF THE INVENTION

The present invention provides a device for opening the jaws of an anesthetized animal for the purpose of endotracheal intubation, oral and pharyngeal visualization, oral surgery and the like. The invention can be used to retain the jaws of an animal in an open position safely and reliably and can be adjusted to work effectively on a variety of animal species. The device comprises a pair of jaw retainers which are separated by at least one biasing means, preferably a spring biasing means. Each retainer comprises a rigid portion which rests on the outer, epidermal portion of the upper or lower jaw of the animal for which the device is to be used. Each retainer also has an inner, adjustable portion which contacts the inside toothed-portion of the animal's upper or lower jaw. The inner portions are preferably flexible and somewhat soft, rather than rigid, to minimize discomfort to the animal. The inner portion may also be adjustable so that large and small jaw structures can be accommodated by the device.

It is an object of the present invention to provide a mouth opening apparatus which can be operated by a single person and which can retract and hold open the upper and lower jaws of an anesthetized animal.

It is another object of the present invention to establish a controlled condition to facilitate the proper placement or replacement of an endotracheal tube into and down the trachea of an animal.

It is yet another object of the present invention to provide a device which retains an animal's mouth in an open position to allow visualization or examination of oral and pharyngeal structures of the animal.

It is yet another object of the present invention to provide a device which gives an operator full and unobstructed view and continuous access to an animal's mouth and pharyngeal structure, which can remain in place in an animal's mouth until deemed unnecessary.

It is further an object of the present invention to provide a device for retracting the mouth of an animal which may quickly adjust to and correspond to the size of the mouth and the extent of its opening and which can be used on animals lacking protruding canine teeth and being of large or small size.

It is yet a further object of the present invention to provide a device of this type which is simple, practical, and lightweight, which is efficient and reliable in operation and which is convenient to apply to or remove from an animal's mouth.

These and other objects are accomplished by a device according to the present invention which comprises an upper and a lower jaw retaining mechanism separated by a spring biasing means. The upper and lower jaw retaining members are adjustable in size to accommodate the jaws of various animal species used in the laboratory. The device can be used on animals both with and without protruding canine teeth. The device is adjustable with respect to the size of an animal's jaw which it can accommodate and the size of the opening between an animal's upper and lower jaw.

BRIEF DESCRIPTION OF THE DRAWINGS

The present invention can be more fully understood with reference to following drawings, wherein.

DETAILED DESCRIPTION OF THE INVENTION

The jaw retainers are held apart from each other by at least one retainer rod. The rod is slidably received in a hole in each jaw retainer. Protrusions or other means are provided on opposite ends of the rod so that the jaw retainers cannot slide off of the retainer rod. To force the jaw retainers apart from each other, a biasing means, preferably a spring biasing means, is provided around or near the retainer rod. In a preferred embodiment, a compression spring surrounds the retainer rod so that the rod can give support to the spring.

Figure 1:
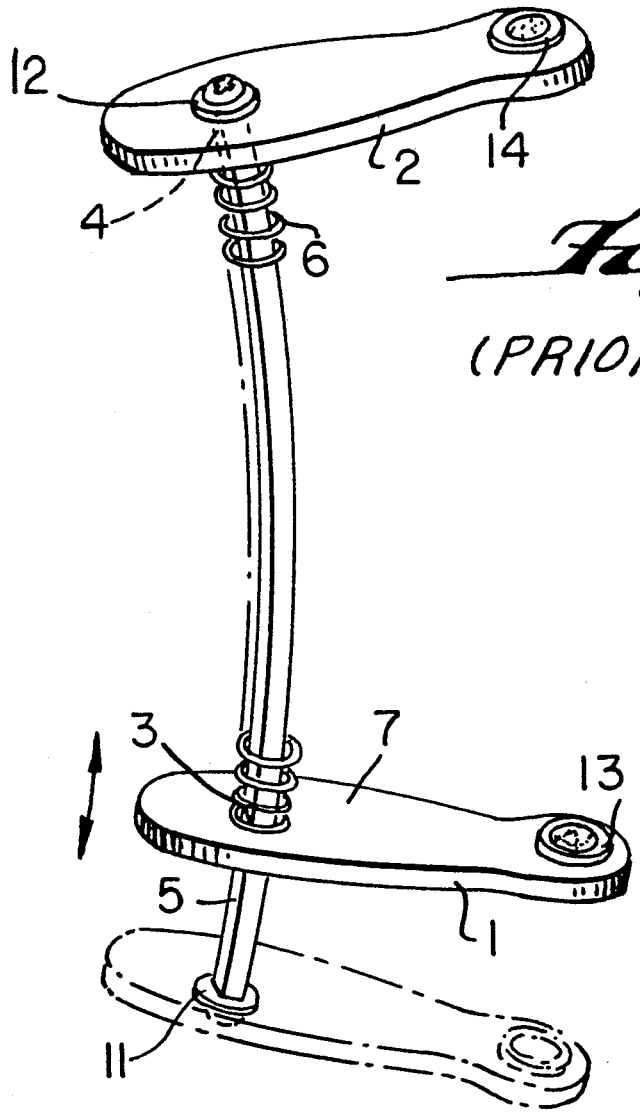
Fig. 1. (PRIOR ART)
FIG. 1 represents a prior art animal mouth retractor.
Figure 2:
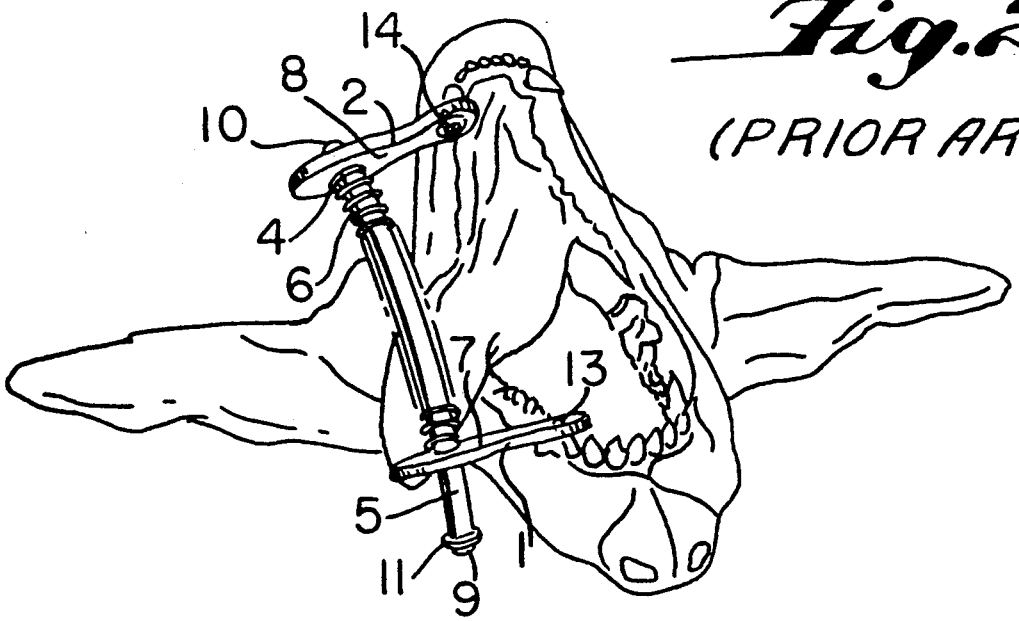
Fig. 2. (PRIOR ART)
FIG. 2 represents the prior art retractor of FIG. 1 in use in the mouth of a dog.
Figure 3:
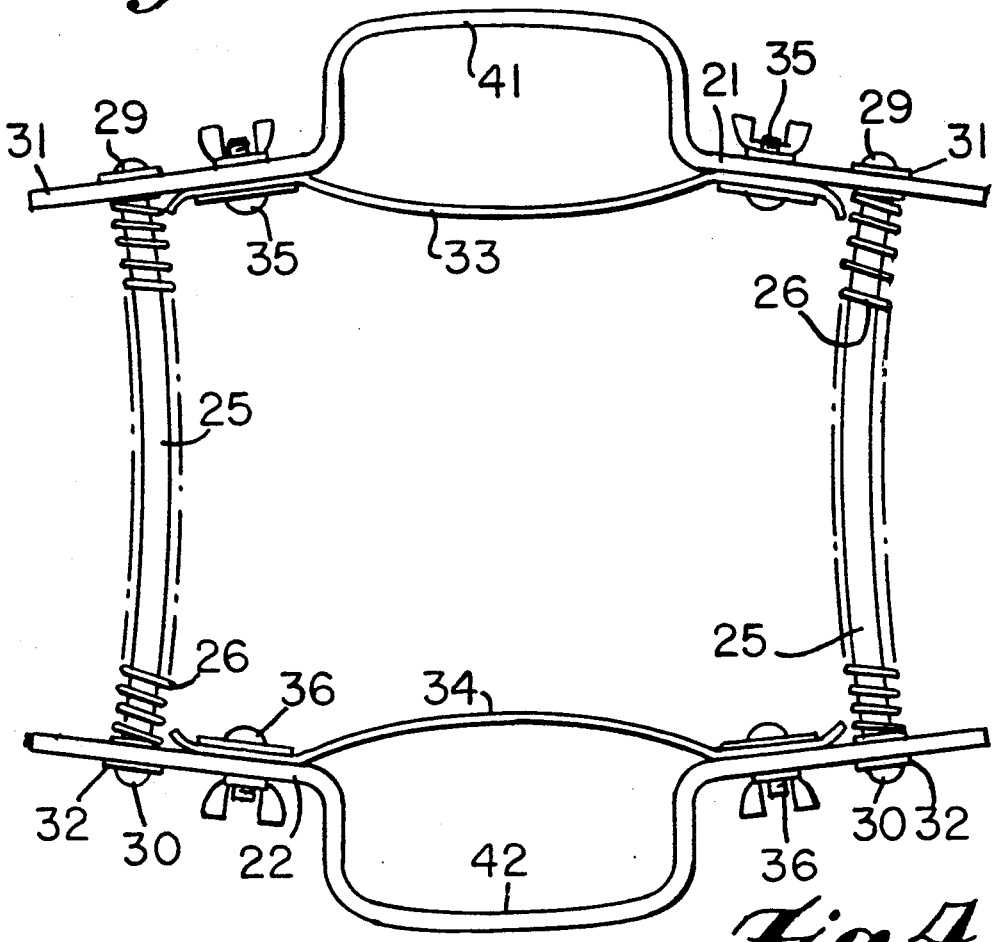
FIG. 3 represents a device according to the present invention.
Figure 4:
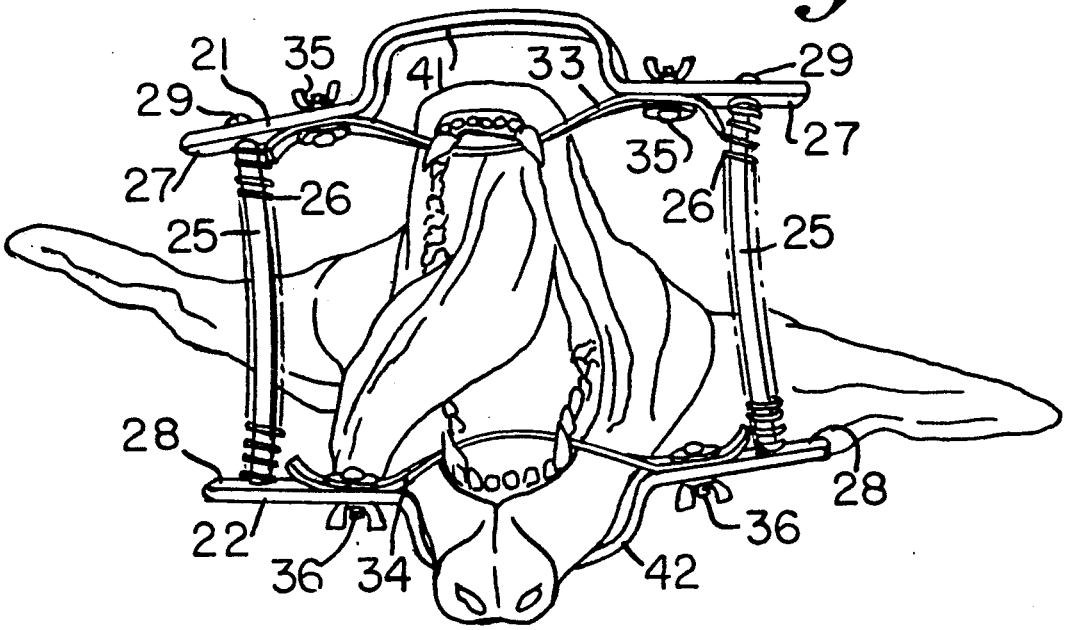
FIG. 4 represents a device according to the present invention in operation in a dog's mouth.

Referring now to FIGS. 3 and 4, a device according to the present invention comprises a pair of spaced elongated arms 21 and 22 having holes (not shown) formed therethrough at first and second ends of each arm. These holes have a substantially square cross-section and slidably receive retainer rods 25 each having a complimentary square cross-section. A compression spring 26 surrounds each retainer rod 25 and has the opposite ends thereof in engagement with facing surfaces 27 and 28 of the two arms. The spring preferably comprises a non-corrosive metal such as stainless steel. Opposite ends of each retainer rod are provided with threaded holes (not shown) which receive threaded bolts 29 and 30 therein. Washers 31 and 32 surround the bolts and are positioned between the ends of retainer rods 25 and the heads of the bolts. The bolts and washers prevent the ends of the retainer rods from passing through the substantially square cross-section holes while maintaining springs 26 under compression.

During assembly of the device, the threaded bolts 29 or 30 are screwed into the threaded holes at one end of each retainer rod. Then, one jaw retainer, the compression spring and the other jaw retainer, sequentially, are slid onto the retainer rods. The springs are then compressed and held while the other threaded bolts are screwed into the opposite ends of the retainer rods.

Each jaw retainer 21 and 22 comprises a flexible jaw strap, 33 and 34, respectively, which contact the toothed-surface of either an upper or lower jaw. Each strap is connected to its corresponding jaw retainer by two mounting screws 35 or 36 which are inserted through holes (not shown) in the strap and through holes (not shown) in the arms and secured by wing nuts. A plurality of holes may be provided on each strap so that the amount of slack in the strap may be adjusted. Straps of different widths may be employed to accommodate the jaws of smaller animals, such as cats, rabbits, and ferrets. For smaller animals such as cats, rabbits, or ferrets, a strap having a width of about ¼ inch is preferred. For larger animals such as dogs and pigs, a strap having a width of about ⅝ inch is preferred. This allows use of the device on jaws of various animal species and sizes. For instance, the device can be used on laboratory animals such as dogs, pigs, sheep, goats, cats, rabbits, and ferrets as well as zoo animals such as wolves, foxes, hyenas, etc. Washers may also be provided between the mounting screws 35, 36 and each strap and between each strap and its associated retainer.

Each jaw retainer 21 and 22 comprises an intermediate section 41 and 42, respectively. These intermediate sections span the jaw of the animal and connect first and second end portions of each retainer. The intermediate sections allow the device to accommodate the outer portions of the upper and lower jaws. The intermediate section may be arched and may be large enough to accommodate jaws of very large animals such as adult pigs, sheep or goats.

The device exerts pressure on the inside portions of the jaws, i.e. the teeth. The shape and contour of the arch only needs to accommodate the outer jaws since the arch does not have to contact the outer jaw in most cases.

Figure 5:
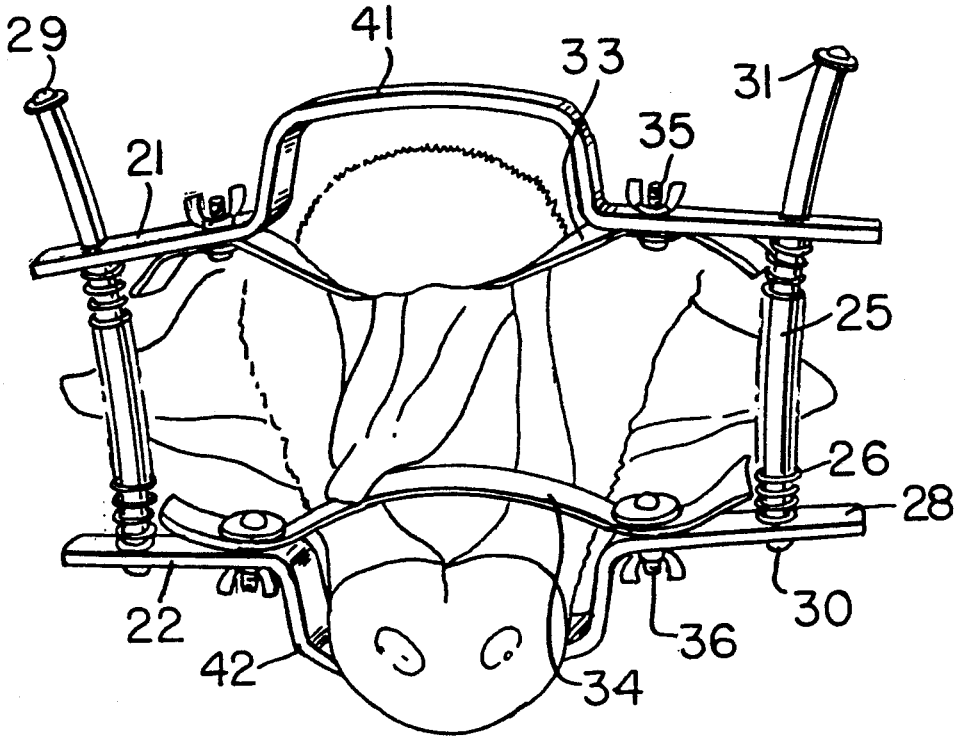
FIG. 5 represents a device according to the present invention in operation in a pig's mouth.

The manner in which the retractor works is illustrated in FIGS. 4 and 5 wherein the upper and lower jaws of a dog (FIG. 4) and a pig (FIG. 5) are received within the jaw retainers and urged apart by the compression springs 26. As can be seen in FIG. 5, the apparatus can hold the jaws of an animal which does not have protruding canine teeth, in spaced relationship. In both FIGS. 4 and 5 the flexible jaw straps contact the toothed-surface of both the upper and lower jaw.

The rigid portions of the retainers are preferably made of a medical grade stainless steel, gold or gold plate which will not rust or corrode over time. The inner-portion retaining means may be disposable for sanitary or aseptic purposes. Plastic and silicones may also be used as well as other suitable materials. In a preferred embodiment, the inner portion retaining means comprises a nylon strap which is flexible, sturdy, inexpensive and which minimizes discomfort to the animal.

Figure 6:
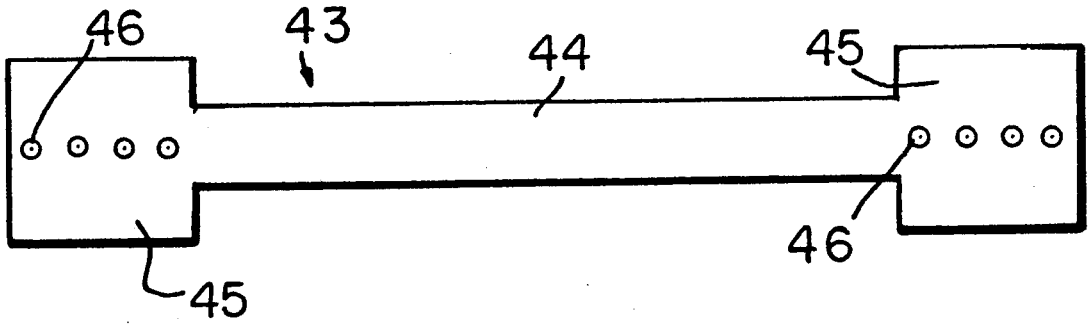
FIG. 6, represents a flexible jaw engaging means according to an embodiment of the present invention.

FIG. 6 shows a strap 43 according to an embodiment of the invention for use on a smaller animal such as a cat, ferret or rabbit. The strap 43 is about ¼ inch wide at a jaw engagement portion 44. At both ends of the strap a widened portion 45 is provided which adds strength in the areas where through holes 46 are formed. The strap is mounted to a corresponding jaw retainer with mounting screws such as screws 35 or 36 shown in FIGS. 3 and 4.

Although the present invention has been described in connection with preferred embodiments, it will be appreciated by those skilled in the art that additions, modifications, substitutions and deletions not specifically described may be made without departing from the spirit and scope of the invention defined in the appended claims.

I claim:

1. An animal mouth retractor comprising:

a pair of spaced retainer means, each of said retainer means including first and second end portions adapted to be positioned at opposite sides of a jaw of an animal, each of said retainer means including an intermediate portion joining said first and second end portions and being adapted to span a jaw of an animal;

jaw engaging means connected between the first and second end portions of each of said retainer means and spaced from the associated intermediate portion to receive a jaw between each jaw engaging means and the associated intermediate portion;

guide means outboard of said jaw engaging means of said retainer means and engaging end portions of the retainer means for guiding movement of said retainer means relative to one another; and spring biasing means for automatically and continuously urging said retainer means away from one another without any manual manipulation to provide an infinite number of separation distances between the pair of jaw retainers.

2. An animal mouth retractor as in claim 1, wherein said intermediate portion comprises an arched section to accommodate the curved outer portion of an animal's jaw.

3. An animal mouth retractor as in claim 1, wherein said jaw engaging means comprise a strap, said strap being elongated and including opposite, parallel flat surfaces having a width and a thickness, said width being much greater than said thickness so that the strap can fit around and conform to the inner surface of the jaw of an animal.

4. An animal mouth retractor as in claim 3, wherein said strap is adjustable in length.

5. An animal mouth retractor as in claim 4, wherein said strap has a plurality of holes formed therein.

6. An animal mouth retractor as in claim 3, wherein said strap comprises nylon.

7. An animal moth retractor as in claim 1, wherein said retainer means substantially comprise stainless steel.

8. An animal mouth retractor comprising:

a pair of spaced retainer means, each of said retainer means including first and second end portions adapted to be positioned at opposite sides of a jaw of an animal, each of said retainer means including an intermediate portion joining said first and second end portions and being adapted to span a jaw of an animal;

jaw engaging means connected between the first and second end portions of each of said retainer means and spaced from the associated intermediate portion to receive a jaw between each jaw engaging means and the associated intermediate portion; and means for continuously urging said retainer means away from one another, wherein said pair of spaced retainer means are slidably movable on, and maintained in alignment with respect to each other by, at least two rods.

9. An animal mouth retractor as in claim 8, wherein said retainer means each comprise through-holes through which said rods are slidably movable.

10. An animal mouth retractor as in claim 8, wherein each rod includes means to prevent the mouth retainers from sliding off of the rod.

11. An animal mouth retractor as in claim 8, wherein a spring surrounds at least one said rod and acts to force said retainer means apart from one another.

12. An animal mouth retractor comprising:

a pair of spaced rigid retainer means, each of said retainer means including first and second end portions adapted to be positioned at opposite sides of a jaw of an animal, each of said retainer means including an intermediate portion joining said first and second end portions and being adapted to span a jaw of an animal;

a flexible jaw engaging strap connected between the first and second end portions of each of said retainer means and spaced from the associated intermediate portion to receive a jaw between each jaw engaging means and the associated intermediate portion, said strap being elongated and including opposite, parallel flat surfaces having a width and a thickness, said width being much greater than said thickness, so that the strap can fit around and conform to the inner surface of the jaw of an animal; and spring biasing means for automatically and continuously urging said retainer means away from one another without any manual manipulation to provide an infinite number of separation distances between the pair of jaw retainers.

13. An animal mouth retractor as in claim 12, wherein said intermediate portion comprises an arched section to accommodate the curved outer portion of an animal's jaw.

14. An animal mouth retractor as in claim 12, wherein said strap is adjustable in length.

15. An animal mouth retractor as in claim 14, wherein said strap has a plurality of holes formed therein.

16. An animal mouth retractor as in claim 12, wherein said strap comprises nylon.

17. An animal mouth retractor as in claim 7, wherein said retainer means substantially comprise stainless steel.

18. An animal mouth retractor as in claim 7, wherein said strap has a width of ¼ inch.

19. An animal mouth retractor comprising:

a pair of spaced retainer means, each of said retainer means including first and second end portions adapted to be positioned at opposite sides of a jaw of an animal, each of said retainer means including an intermediate portion joining said first and second end portions and being adapted to span a jaw of an animal;

flexible jaw engaging means connected between the first and second end portions of each of said retainer means and spaced from the associated intermediate portion to receive a jaw between each jaw engaging means and the associated intermediate portion; and means for continuously urging said retainer means away from one another, wherein said pair of spaced retainer means are slidable movable on, and maintained in alignment with respect to each other by, at least two rods.

20. An animal mouth retractor as in claim 19, wherein said retainer means each comprise through-holes through which said rods are slidably movable.

21. An animal mouth retractor as in claim 19, wherein each rod includes means to prevent the mouth retainers from sliding off of the rod.

22. An animal mouth retractor as in claim 19, wherein a spring surrounds at least one said rod and acts to force said retainer means apart from one another.

* * * * *